US010485387B2

(12) United States Patent
Kadirov

(10) Patent No.: US 10,485,387 B2
(45) Date of Patent: Nov. 26, 2019

(54) SPONGE MADE OF LUFFA

(71) Applicant: Nariman Kadirov, Tashkent (UZ)

(72) Inventor: Nariman Kadirov, Tashkent (UZ)

( * ) Notice: Subject to any disclaimer, the term of this patent is extended or adjusted under 35 U.S.C. 154(b) by 0 days.

(21) Appl. No.: 15/580,573

(22) PCT Filed: May 5, 2016

(86) PCT No.: PCT/UZ2016/000001

§ 371 (c)(1),
(2) Date: Dec. 7, 2017

(87) PCT Pub. No.: WO2016/201457

PCT Pub. Date: Dec. 15, 2016

(65) Prior Publication Data

US 2018/0168408 A1 Jun. 21, 2018

(30) Foreign Application Priority Data

Jun. 10, 2015 (UZ) ..... 20150088

(51) Int. Cl.
*A47K 7/02* (2006.01)
*A47L 13/16* (2006.01)

(52) U.S. Cl.
CPC ..... *A47K 7/02* (2013.01); *A47L 13/16* (2013.01)

(58) Field of Classification Search
CPC ..... A47L 13/10; A47L 13/16; A47L 13/17; A47K 7/02; A47K 7/022; A47K 7/03
USPC ..... 15/208, 209.1, 222, 244.1, 244.3, 244.4
See application file for complete search history.

(56) References Cited

U.S. PATENT DOCUMENTS

| | | | | |
|---|---|---|---|---|
| 405,806 | A | 6/1889 | Judson | |
| 6,656,565 | B2 * | 12/2003 | Harrison | A47K 7/02 15/209.1 |

FOREIGN PATENT DOCUMENTS

| | | |
|---|---|---|
| GB | 2267028 | * 11/1993 |
| JP | 2002300984 | 10/2002 |
| JP | 2011-24895 | * 2/2011 |
| SU | 1595452 | 9/1990 |

* cited by examiner

*Primary Examiner* — Mark Spisich
(74) *Attorney, Agent, or Firm* — Defillo & Associates, Inc.; Evelyn A Defillo

(57) ABSTRACT

The sponge made of two layers, formed by the walls of the fine-fibered luffa fruit is offered. Each layer is at least a part of the wall of the luffa fruit with the adjacent radial jugums, the layers are adjacent to each other from the side of the radial jugums and are connected along the perimeter with a seam located under the frame manufactured from a narrow fabric or cloth. The preservation of a stable structural formation of the wall of the luffa fruit in the sponge layers increases its strength while preserving its elasticity.

4 Claims, 2 Drawing Sheets

SPONGE MADE OF LUFFA

CROSS REFERENCE TO RELATED APPLICATION

This application is a national stage entry of PCT/UZ2016/000001 filed May 5, 2016, under the International Convention claiming priority over Uzbekistan Patent Application No. FAP 20150088 filed Jun. 10, 2015.

TECHNICAL FIELD OF THE INVENTION

The invention relates to household items, in particular to sponges made of plant materials, in particular of luffa, intended for washing, cleansing and massaging a human skin.

BACKGROUND OF THE INVENTION

The closest to the offered sponge is a sponge (Japanese patent JP 2002300984 A, Oct. 15, 2002) containing a working member made of two layers, one of which is made of the net material, and the other one is made of the luffa fruit longitudinally cut without a central pith and radial jugums, the wall thickness of which is reduced by cutting a certain layer from the inside. The working member layers are adjacent to each other and connected along the perimeter with a frame manufactured from a strip of cloth, wherein on one side of the working member there is a link manufactured from a narrow fabric for the fixation on the hand.

The disadvantage of the known sponge is the unreliability created by the lack of a stable ability of the working member layer to perform the functions. This is due to the fact that the working member layer is manufactured from the luffa fruit, the wall thickness of which is reduced by cutting a certain layer from the inside and is explained by the following.

The inner part of the wall and the radial jugums consist of the tightly adjacent to each other, interweaved structure-forming and fruit-reinforcing fibers and are the basis of a stable structure of the formation of the fruit wall. The removal of the inner part of the fruit wall disrupts the continuity of the fibers' interweaving, destroys the basis of the structure of the formation in the outer part of the fruit wall. Making the working member layer of the part of the fruit wall with the cuttings of the structure-forming and fruit-reinforcing fibers, which are deprived of the connections with the basis integrating in a stable structure, which is in the cut inner part of the fruit wall and the radial jugums, determines the instability of the structure of the formation of the working member layer, leading to the lack of a stable ability of the working member layer to perform the functions, makes the sponge unreliable.

The disadvantage of the known sponge is manufacturing another working member layer from the net material with which the user's hand enwrapped by the link contacts, what does not correspond to the essential human need for using natural materials in skin care products.

The disadvantage of the known sponge is the labour intensity of the process of manufacturing the working member layer from luffa, due to the constant need to establish the thickness of the layer cut, depending on the wall thickness of each fruit of the luffa used.

SUMMARY OF THE INVENTION

The object of the invention is the development of a sponge made of luffa, having reliability, safety for the user, corresponding to the essential human need for using natural materials in skin care products, having improved performance characteristics, convenience in an industrial manufacture by means of the design solutions and the maximum use of the luffa properties, namely a stable ability of the working member to perform the functions, the absence of the contamination after the use, with both parts of the working member made of luffa, which can be manufactured simply and rapidly.

The object set has been solved in the following way.

The sponge contains a working member made of two layers manufactured from a fine-fibred luffa of the "*Luffa cylindrica* Roem" species. Each working member layer is at least a part of the wall of the luffa fruit with the adjacent radial jugums. The working member layers are adjacent to each other from the side of the radial jugums, framed with a narrow fabric or cloth and connected along the perimeter with a seam, located under the frame manufactured from a narrow fabric or cloth. Wherein the sponge contains a loop for hanging fixed at one end.

The invention uses a fine-fibred luffa of the "*Luffa cylindrica* Roem" species (agrolib.ru/rastenievodstvo/item/f00/s01/e0001140/index.shtml). This luffa's fruit is a dense, tender, fine-fibred net. The fruit wall and the radial jugums are interweaved, but not adjacent to each other, tender and thin fibers, what determines the spatial structure of the net formation from individual fibers. The inner part of the wall and the radial jugums of the fruit are a net from fine structure-forming and fruit-reinforcing fibers. The outer part of the fruit wall is a net from tender and thin fibers. The fibers of the fruit wall and the radial jugums are characterized by a high porosity and capillarity.

In the places where the radial jugums are adjacent to the inner part of the fruit wall in the net structure, a transition of the structure-forming and fruit-reinforcing fibers from the region of the radial jugums to the region of the inner part of the fruit wall is clearly indicated. This shows that the stability of the structural formation of the fruit wall depends on the continuity of the fiber connections at the places where the radial jugums are adjacent to the inner part of the fruit wall.

The working member layers of the invention are made as having the radial jugums. This solution allows preserving the continuity of interweaving of the fibers in the entire region of the adjunction of the radial jugums to the inner part of the fruit wall, leading to the stability of the structure of the formation of the fruit wall, which determines the stable ability of the working member layer to perform the functions, what creates the reliability of the sponge.

The net with a spatial structure of the formation from tender and thin fibers with a high porosity, capillarity, forming the working member layers, allows for a rapid absorption and return of water, creates the possibility of a complete washout of the contaminations from the pores of the fibers, a through washout, a through ventilation and a rapid drying of the working member layers and the space between the working member layers, leading to the absence of the contamination of the sponge after the use, what makes the sponge safe for the user.

The high porosity and capillarity of the tender and thin fibers determine a significant increase in the volume of the fibers during the use, allow for a rapid absorption and return of water and in combination with the spatial structure of the formation of the net lead to a high elasticity of the working member layers. This determines a deep cleansing of the pores, a gentle exfoliation of the dead skin cells, a lymphatic drainage and massage effect and, due to a high foaming at the contact with moisturizing cosmetics, an excellent moisturizing, what gives the sponge improved performance characteristics.

Manufacturing both working member layers from luffa corresponds to the essential human need for using natural materials in skin care products. Manufacturing both working member layers having radial jugums and adjacent to each other on the side of the radial jugums creates the volume of the working member, makes the sponge comfortable for the fixation in the user's hand, comfortable when used in accordance with the individual anthropometric peculiarities.

Making the sponge of various shapes, for example, oval (as indicated at FIG. 1) or some other shape, including with the presence of loop-like grips manufactured from a cord or a narrow fabric at both edges of the working element for the fixation in hands, or with the presence on one side of the working member of a link manufactured from a narrow fabric for the fixation on the hand, ensures the possibility of washing, cleansing and massaging the human skin in accordance with his anthropometric peculiarities and creates comfortable conditions for the user when using the product.

Making on one side of the working member of a link for the fixation on the hand manufactured from an elastic narrow fabric allows to locate the link on the other side, creating the possibility of using both working member layers as an active washing, cleansing, massaging layer, what increases the service life of the product.

The structure of the formation of the working member and the radial jugums, characterized by the compression possibility, ensures the implementation of cross-linking and framing.

Joining two working member layers along the perimeter with a seam, located under the frame manufactured from a narrow fabric or cloth increases the reliability of the sponge.

Making the working member of the luffa unbleached or bleached, or coloured, or processed with extracts, or of the organic luffa uncoloured or coloured with natural colouring agents, or processed with natural extracts corresponds to the satisfaction of various customer needs.

BRIEF DESCRIPTION OF THE DRAWINGS

The invention is illustrated by the drawings, where.

DETAILED DESCRIPTION OF THE INVENTION

Figure 1:
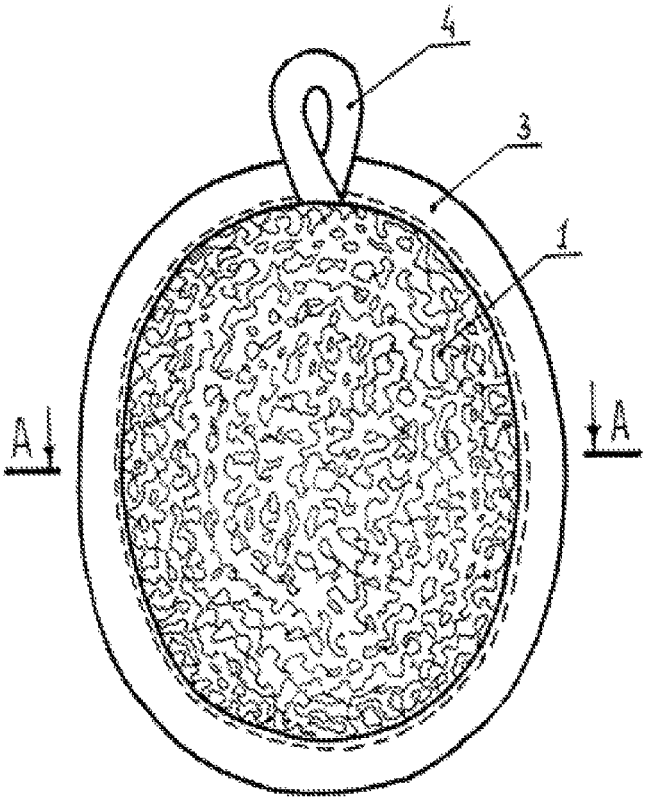
FIG. 1 shows a front view of the offered sponge.
Figure 2:
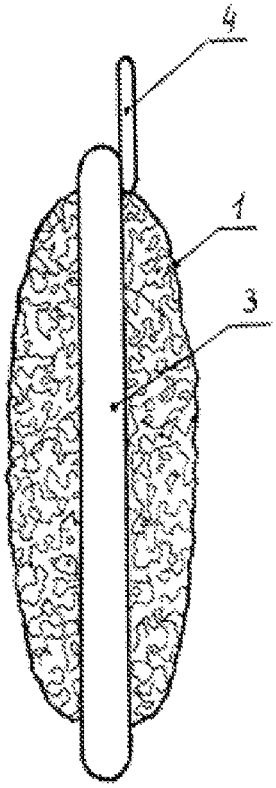
FIG. 2 shows a side view of the sponge.
Figure 3:
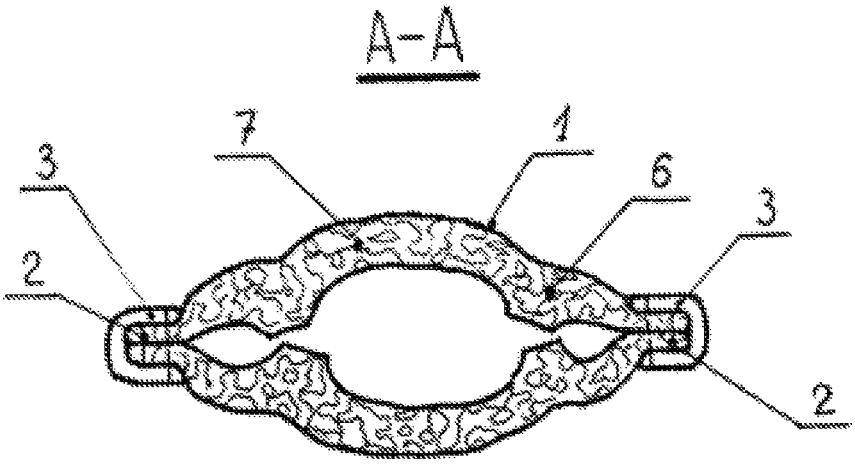
FIG. 3 shows an A-A sectional view at FIG. 1.
Figure 4:
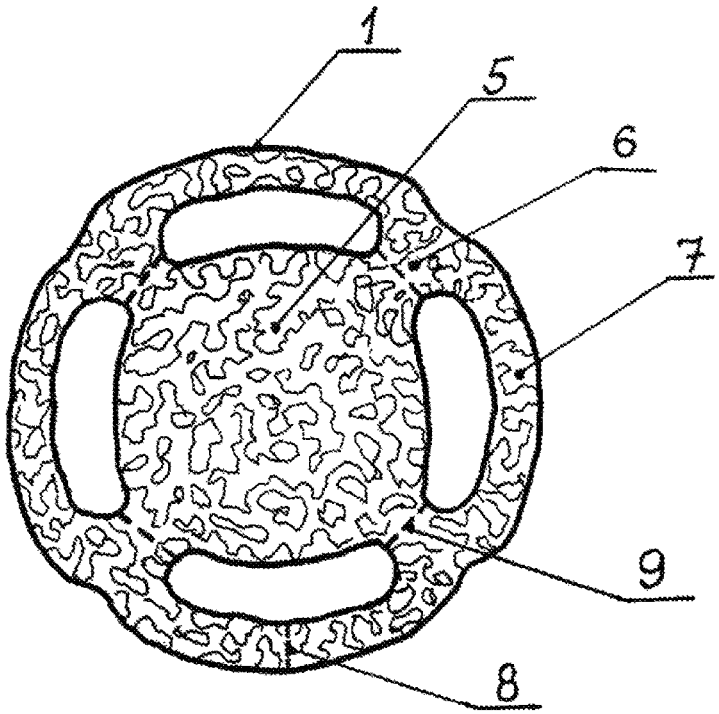
FIG. 4 and FIG. 5 show a cross-sectional view of the luffa fruit before and after the removal of the central pith.
Figure 5:
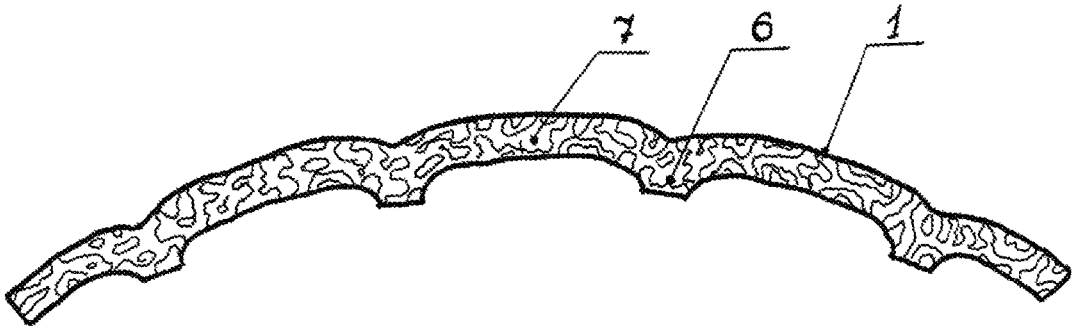

The sponge includes two working member layers 1, a frame manufactured from a narrow fabric or cloth 3 and a loop for hanging 4, manufactured from the same material.

The sponge is manufactured as follows. The wall of the luffa fruit 7 is cut longitudinally along the line 8, the central pith 5 is removed by the consecutive separation along the line 9 from the radial jugums 6. The remaining part of the fruit, which is the fruit wall 7 with the adjacent radial jugums 6, is used for the manufacture of at least one working member layer 1 of a certain shape. The working member is made of two layers 1, having the radial jugums 6 and adjacent to each other from the side of the radial jugums, which are connected along the perimeter with a sewing seam 2, the edges are framed along the perimeter with a narrow fabric or cloth 3. The sponge at one end is provided with a loop for hanging 4, manufactured from the same material.

The invention claimed is:

1. A sponge comprising:

a working member made of:

a first layer made of a part of a wall of a cylindrical roem luffa on a first side including radial jugums on a second side, the first layer including a perimeter and ends;

a second layer made of a part of a wall of a cylindrical roem luffa on a first side including radial jugums on a second side, the second layer including a perimeter and ends;

wherein the jugums on the second side of the first layer are placed spaced from and facing the jugums on the second side of the second layer;

wherein the ends of the first layer are connected to the corresponding ends of the second layer;

a frame manufactured from a narrow fabric or cloth, the frame covers the connection between the first layer and the second layer; and a loop placed on an end of the sponge; the loop is adapted to hang the sponge.

2. The sponge according to claim 1, wherein the layers are manufactured from unbleached luffa or bleached luffa colored or processed luffa with extracts; an organic luffa uncolored or colored with natural coloring agents; or a luffa processed with natural extracts.

3. The sponge according to claim 1, wherein the loop is manufactured from a cord or a narrow fabric.

4. A sponge consisting of:

a working member made of:

a first layer made of a part of a wall of a cylindrical roem luffa on a first side including radial jugums on a second side, the first layer including a perimeter and ends;

a second layer made of a part of a wall of a cylindrical roem luffa on a first side including radial jugums on a second side, the second layer including a perimeter and ends;

wherein the jugums on the second side of the first layer are placed spaced from and facing the jugums on the second side of the second layer;

wherein the ends of the first layer are connected to the corresponding ends of the second layer;

a frame manufactured from a narrow fabric or cloth, the frame covers the connection between the first layer and the second layer; and a loop placed on an end of the sponge; the loop is adapted to hang the sponge.

* * * * *